US007643764B2

(12) United States Patent
Gross et al.

(10) Patent No.: US 7,643,764 B2
(45) Date of Patent: Jan. 5, 2010

(54) REFLECTIVE SENSOR SAMPLING FOR TONE REPRODUCTION CONTROL REGULATION

(75) Inventors: Eric M. Gross, Rochester, NY (US); Palghat S. Ramesh, Pittsford, NY (US); Thomas F. Shane, Seneca Falls, NY (US)

(73) Assignee: Xerox Corporation, Norwalk, CT (US)

( * ) Notice: Subject to any disclaimer, the term of this patent is extended or adjusted under 35 U.S.C. 154(b) by 311 days.

(21) Appl. No.: 11/625,561

(22) Filed: Jan. 22, 2007

(65) Prior Publication Data

US 2008/0175610 A1 Jul. 24, 2008

(51) Int. Cl.
*G03G 15/00* (2006.01)

(52) U.S. Cl. ..... 399/49; 399/72

(58) Field of Classification Search ..... 399/49
See application file for complete search history.

(56) References Cited

U.S. PATENT DOCUMENTS 5,777,656 A * 7/1998 Henderson ..... 347/251
5,822,079 A * 10/1998 Okuno et al. ..... 358/300
6,462,821 B1 10/2002 Borton et al.
2003/0063275 A1* 4/2003 Hubble et al. ..... 356/319
2006/0024077 A1* 2/2006 Scheuer et al. ..... 399/74
2006/0198648 A1* 9/2006 Itagaki ..... 399/49
2007/0071470 A1* 3/2007 Ravitz et al. ..... 399/49
2007/0081163 A1* 4/2007 Liang et al. ..... 356/445

FOREIGN PATENT DOCUMENTS

EP 0 094 027 A1 11/1983
EP 0 772 345 A2 5/1997
EP 0 774 669 A1 5/1997

* cited by examiner

*Primary Examiner*—David M Gray
*Assistant Examiner*—Billy J Lactaoen
(74) *Attorney, Agent, or Firm*—Oliff & Berridge, PLC

(57) ABSTRACT

A method of monitoring one or more patches in an image-processing device comprised of photoreceptor, a controller, and a sensor, includes obtaining specular readings and diffuse readings from the one or more patches and computing values received from the readings. In addition, the one or more patches are from about 0.1 mm to equal or less than the field of view of the sensor where each patch size, location, and approximate value is known; and an analysis of variance (ANOVA) is automatically conducted from the known size, location, and approximate value of each patch.

18 Claims, 4 Drawing Sheets

REFLECTIVE SENSOR SAMPLING FOR TONE REPRODUCTION CONTROL REGULATION

BACKGROUND

The present disclosure is related to methods of monitoring and regulating a xerographic marking device by use of patches, for example inter-document zone (IDZ) control patches, printed in the image area of a photoreceptor device. However, the methods disclosed herein are not restricted to IDZ patches and can be applied to patches printed in an image area and either transferred to paper or sent directly to a toner cleaning mechanism.

In copying or printing systems, such as a xerographic copier, laser printer, or ink-jet printer, a common technique for monitoring the quality of prints is to create a test patch or patch of toner of a predetermined desired density. Therefore, if the density is not at the desired set point, it can be measured and the system can be adjusted to yield the proper density. The actual density of the printing material (toner or ink) in the test patch can then be optically measured to determine the effectiveness of the printing process in placing this printing material on the print sheet.

In the case of xerographic devices, such as a laser printer, the surface that is typically of most interest in determining the density of printing material thereon is the charge-retentive surface or photoreceptor, on which the electrostatic latent image is formed and subsequently, developed by causing toner particles to adhere to areas that are charged in a particular way. In such a case, the optical device for determining the density of toner on a test patch, which is often referred to as a "densitometer" (a reflective sensing device), or a light transmissive sensing device, is disposed along the path of the photoreceptor, directly downstream of the development of the development unit. There is typically a routine within the operating system of the printer to periodically create a test patch of a desired density at predetermined locations on the photoreceptor by deliberately causing the exposure system to charge or discharge as necessary the surface at the location to a predetermined extent.

A test patch is then moved past the developer unit and the toner particles within the developer unit are caused to adhere to the test patch electrostatically. The denser the toner on the test patch, the darker the test patch will appear in optical testing. The developed test patch is moved past a densitometer or a transmissive device disposed along the path of the photoreceptor, and the light absorption of the test patch is tested. The more light that is absorbed by the test patch, the denser the toner on the test patch.

Xerographic test patches are traditionally printed in the inter-document zone (IDZ) on the photoreceptor during an evaluation. They are used to measure the disposition of toner on paper to measure and control the tone reproduction curve (TRC). Currently, most test patches include a solid, mid tone, and highlight patch for evaluation. Unfortunately, the longer the length of each test patch, the more the amount of toner is needed in order to run these tests. Consequently, the larger the test patch, the larger the IDZ needs to be, which results in less job throughput and more toner wasted because the toner in the test patch does not appear on the actual print.

Furthermore, the collection and application of a photoreceptor clean belt profile is both complex and problematic in terms of verifiability, reliability, and timeliness of the updates. Currently, a clean belt profile is performed at start up. The information may be obtained and then stored for later clean belt profiles to compare results; however, not only can using an older clean belt value introduce calibration error, this is a slow process that may need to be repeated several times throughout the life of the device. If it is determined that the photoreceptor has drifted beyond a set point, during cycle up, a collection of the clean belt profile is time consuming. Additionally, the clean belt profiles must be matched with reads in real time so that any read timing errors that exist can be translated into a sensor and therefore color calibration errors.

SUMMARY

While the aforementioned method of monitoring test patches is effective, the tone reproduction curve (TRC) is the only component being measured and controlled.

In embodiments, described is a method of monitoring one or more inter-document patches (components of the TRC), either in an inter-document zone or an image zone, in an image processing device comprised of a photoreceptor, a controller, and a sensor, comprising obtaining specular readings and diffuse readings from the one or more patches and computing values received from the readings, where the one or more patches are equal to or less than the field of view of the sensor. Each patch size, location, and approximate value is known; and an analysis of variance (ANOVA) is automatically conducted from the known size, location, and approximate value of each patch. However, any algorithm, which detects differences such as an ANOVA, may be applied. Furthermore, the geometry and dimensions specified herein are for illustration purposes because there are no known limitations in scaling the concept to even smaller dimensions.

In further embodiments, described is a system for monitoring one or more patches, either in an inter-document zone or an image zone, in an image-processing device, comprising a photoreceptor, a raster output scanner (ROS), a sensor, a controller, and wherein the inter-document patches are from about 0.1 mm to equal to or less than the field of view of the sensor.

In still further embodiments, described is a method of regulating a xerographic marking device comprised of a photoreceptor, a controller, and a sensor, comprising obtaining specular readings and diffuse readings from one or more inter-document patches or image patches, computing specular based developed mass per unit area (DMA) values and/or relative reflectance values, and adjusting the xerographic device's timing and toner image quality based on the information obtained from the one or more inter-document patches or image patches.

The methods and systems herein thus have utility in reducing the size of test patches, reducing the size of inter-documents zones, running a clean belt profile in real-time, adjusting the timing/accuracy of the xerographic marking device in real-time, and reducing time for doing timing, and quality evaluations and adjustments.

EMBODIMENTS

Figure 1:
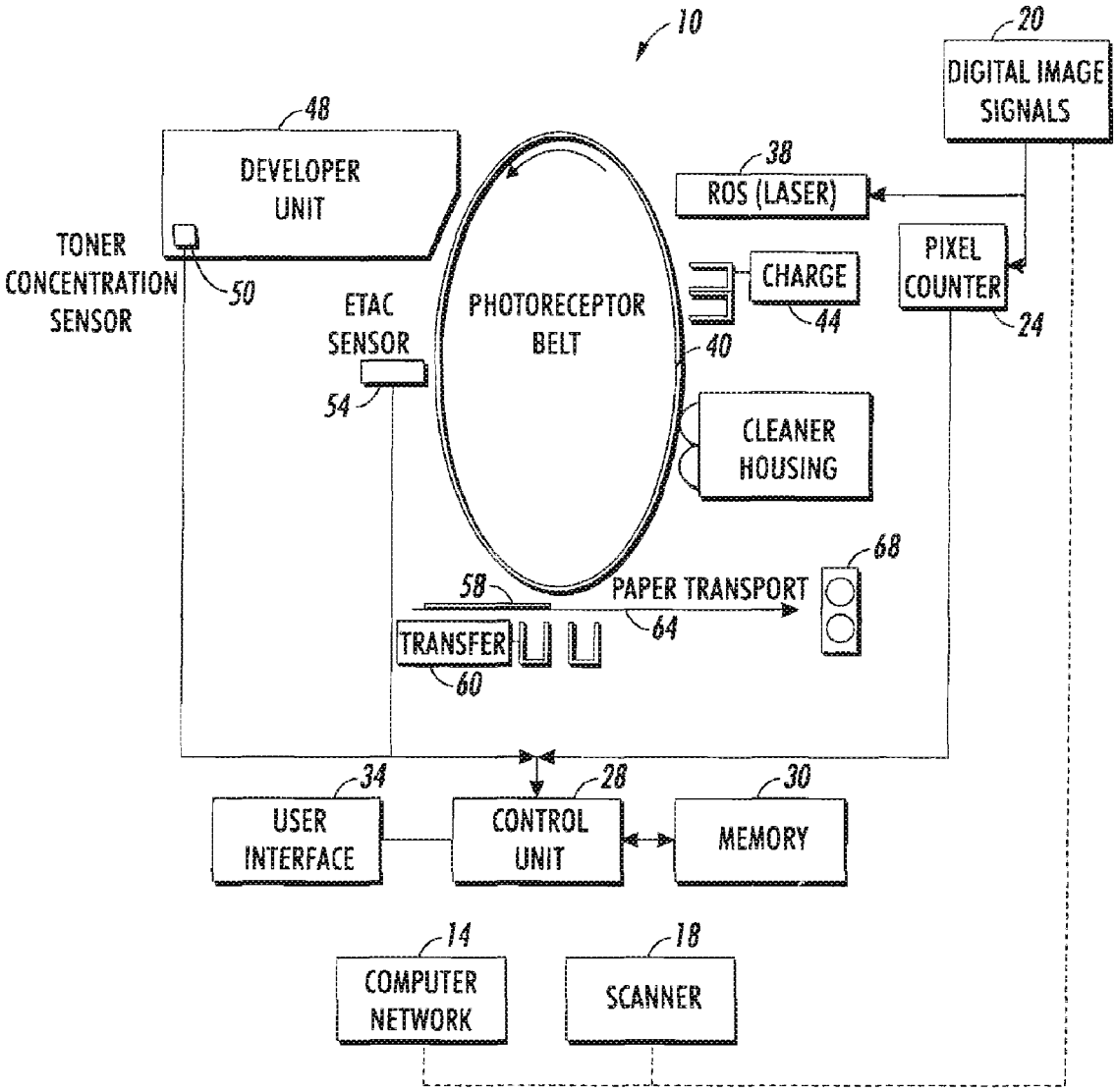
FIG. 1 shows a block diagram of a xerographic marking device in accordance with the present disclosure.

FIG. 1 shows a block diagram of a xerographic marking device in accordance with the present disclosure. The system 10 may include a computer network 14 through which digital documents are received from computers, scanners, and other digital document generators. Also, digital document generators, such as scanner 18, may be coupled to the digital image receiver 20. The data of the digital document images are provided to a pixel counter 24 that is also coupled to a controller 28 having a memory 30 and a user interface 34. The digital document image data is also used to drive the ROS 38. The photoreceptor belt 40 rotates in the direction shown in FIG. 1 for the development of the latent image and the transfer of toner from the latent image to the support material.

To generate a hard copy of a digital document, the photoreceptor belt is charged using corona discharger 44 and then exposed to the ROS 38 to form a latent image on the photoreceptor belt 40. Toner is applied to the latent image from developer unit 48. Signals from toner concentration sensor 50 and ETAC sensor 54 are used by the controller 28 to determine the DMA for images being developed by the system 10. The toner applied to the latent image is transferred to a sheet of support material 58 at transfer station 60 by electrically charging the backside of the sheet 58. The sheet is moved by paper transport 64 to fuser 68 so that the toner is permanently affixed to the sheet 58.

Figure 2:
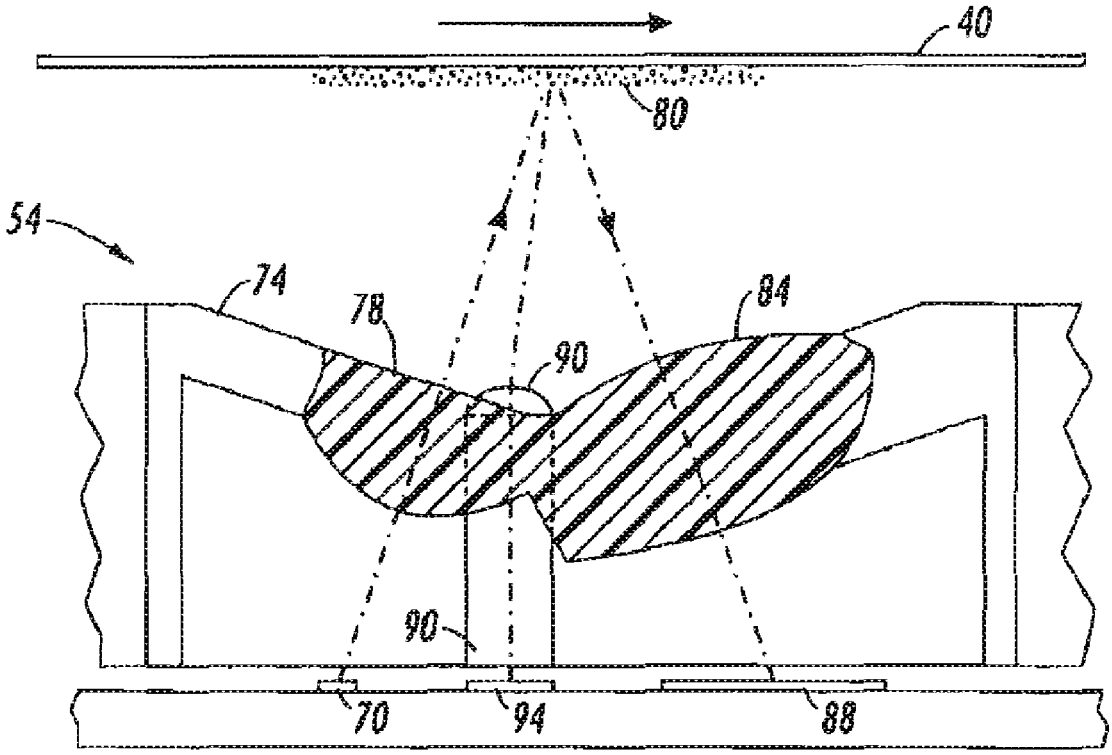
FIG. 2 is a partial side view of an ETAC sensor according to embodiments of the present disclosure.

A reflective sensor, for example, and extended toner area coverage sensor (ETAC), here termed as ETAC sensor 54 shown in FIG. 1, may be an ETAC sensor such as disclosed in U.S. Pat. No. 6,462,821 commonly assigned to the assignee of this application, the disclosure of which is hereby incorporated by reference in this application in its entirety. As shown in FIG. 2, the ETAC sensor may include a LED 70 located within the sensor housing 74. Mounted in the wall of the housing 74 is a lens 78 for collimating the light emitted from LED 70. Emitted light is reflected from toner patch 80 and collected by lens 84 for photodetector 88. Photodetector 88 is centrally located so the light from LED 70 to photodetector 88 is specular reflected light. Laterally offset from the center line between LED 70 and photodetector 88 is a small diameter lenslet 90 for directing reflected light to photodetector 94. This structure enables photodetector 94 to measure the diffuse signals and/or transmitted light signals for light reflected or transmitted from or through photoreceptor 40 by toner patch 80. In the ETAC sensor 54, the LED 70 may be a 940 nm infrared LED emitter and photodetector 88 and 94 may be commercially available PIN or PN photodiodes.

The signals from photodetector 88 and 94 are used in a known manner by the controller 28 to determine a DMA for a toner patch on the photoreceptor belt 40. In response to the detection of toner dirt on the lens 84 or a change in the reflectance of photoreceptor belt 40, the controller 28 may change the intensity of the LED 70, and/or the timing of the photoreceptor belt, and/or make a determination to clean the photoreceptor belt.

Xerographic test patches are traditionally printed in the IDZ on the photoreceptor during an evaluation. While not permanent, their measurements are used for description purposes. The method is conceived to be implemented on a product in which test patches are evaluated for each of solid, mid tone, or highlight, and are each around 11 mm in length, which provides a timing factor of safety ±4 mm. An ETAC will gather information as close to the middle of each test patch as possible, for example, about 5.5 mm. With a standard ETAC field of view of around 3 mm, this allows a 4 mm cushion on either end of the test patch. An obvious concern in making a test patch any smaller than the field of view of the ETAC (smaller than 3 mm) is the timing/accuracy issues, which will be explained in detail below.

Figure 3:
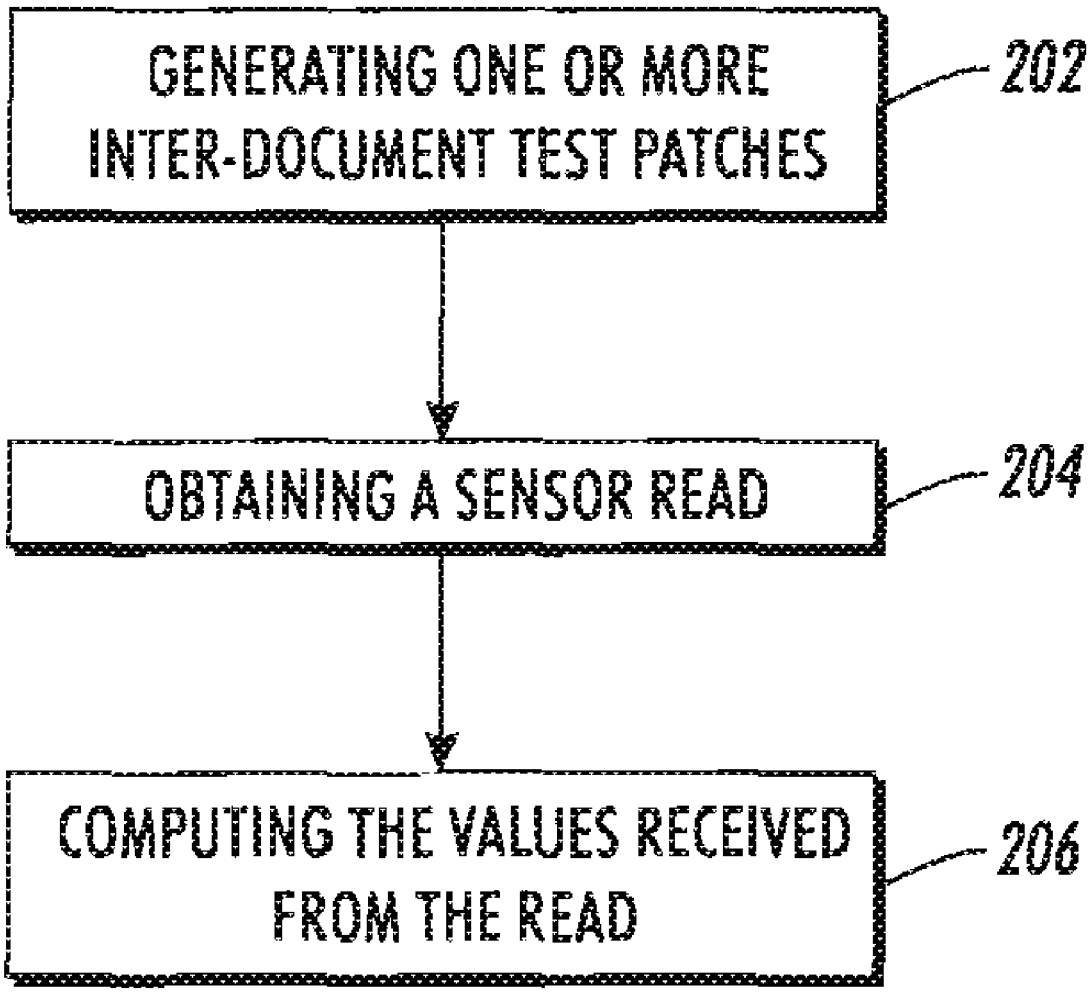
FIG. 3 is a flow chart of a method for monitoring inter-document patches.

A flow chart of a method for monitoring inter-document patches is shown in FIG. 3. The method includes generating one or more inter-document test patches (block 202). There are several types of test patches and therefore several different sequences that test patches may be aligned in. Three common types of TRC test patches are solid, mid tone, and highlight. A typical sequence of TRC test patches is: solid, mid tone, highlight.

In embodiments, TRC test patches are smaller than the field of view of a sensor. In further embodiments, clean belt patches are interspersed between the TRC patches allowing clean belt correction to be performed simultaneously with values obtained from neighboring un-rendered locations. A sequence of test patches that may be used is: clean belt A, solid, clean belt B, mid tone, clean belt C, highlight, clean belt D. However, one of ordinary skill in the art will appreciate that numerous test patches may exist along with various sequences.

Currently, patches are not smaller than the field of view of the sensor because the possibility that the sensor will miss the patch is too great. As mentioned above, patches are typically 11 mm in length, which gives a cushion for error of ±4 mm. This cushion is needed since the timing and accuracy of the sensor is not adjusted often enough nor is it adjusted well enough to make the patch a smaller size even plausible. In embodiments of the present disclosure, patch sizes are about 0.1 mm to about the size of the view of the sensor, for example, about 3 mm.

The following examples further illustrate the methods and system described herein. For illustration purposes, the following is assumed:

1. The ETAC field of view is 3 mm and is rectangular, not oval as it may be in practice.

Therefore, if a patch is 20% within the field of view, then that patch has a 20% contribution to the net specular output.

2. The sensor interface board can sample sufficiently fast. Sufficient rate can be defined as:

$$10*V/L \text{ Hz}$$

If the photoreceptor speed is V, let L be the field of view length in the process direction of the ETAC. A sample rate of 10*V/L Hz will provide 10 samples over the field of view of the device and is on the order of being adequate for these purposes. For example, if L is ~3 mm, and V is ~500 mm/sec, the interface board would need a sampling capability of ~1.66 kHz, which one of ordinary skill in the art will appreciate that 1.66 kHz is well within today's capability.

3. A patch layout and dimensions are pre-specified and therefore known.

For example, with an ETAC field of view of 3 mm, and each patch at 2 mm in length, there will be 6 patch elements in each sample; therefore, it will be assumed that a patch element will be examined once every 0.5 mm. With a 3 point TRC control and an IDZ available size of only 14 mm, an example specification may be:

clean belt A, solid, clean belt B, mid tone, clean belt C, highlight, clean belt D 4. There is no timing error.

For this example, since it is assumed that a patch element is sampled once per 0.5 mm, and with a field of view of 3 mm, there are six patch elements in each sample, which, given the total length of the patches, there are a total of 24 samples per IDZ capture (See Table 1, below). To illustrate the concept further, a tentative assumption will be made regarding start of sampling. Sampling will begin when, for the first time, a group of patches completely fall under the entire ETAC field of view. In turn, sampling will cease when, for the first time, elements not part of the patch layout enter the ETAC field of view.

Figure 4:
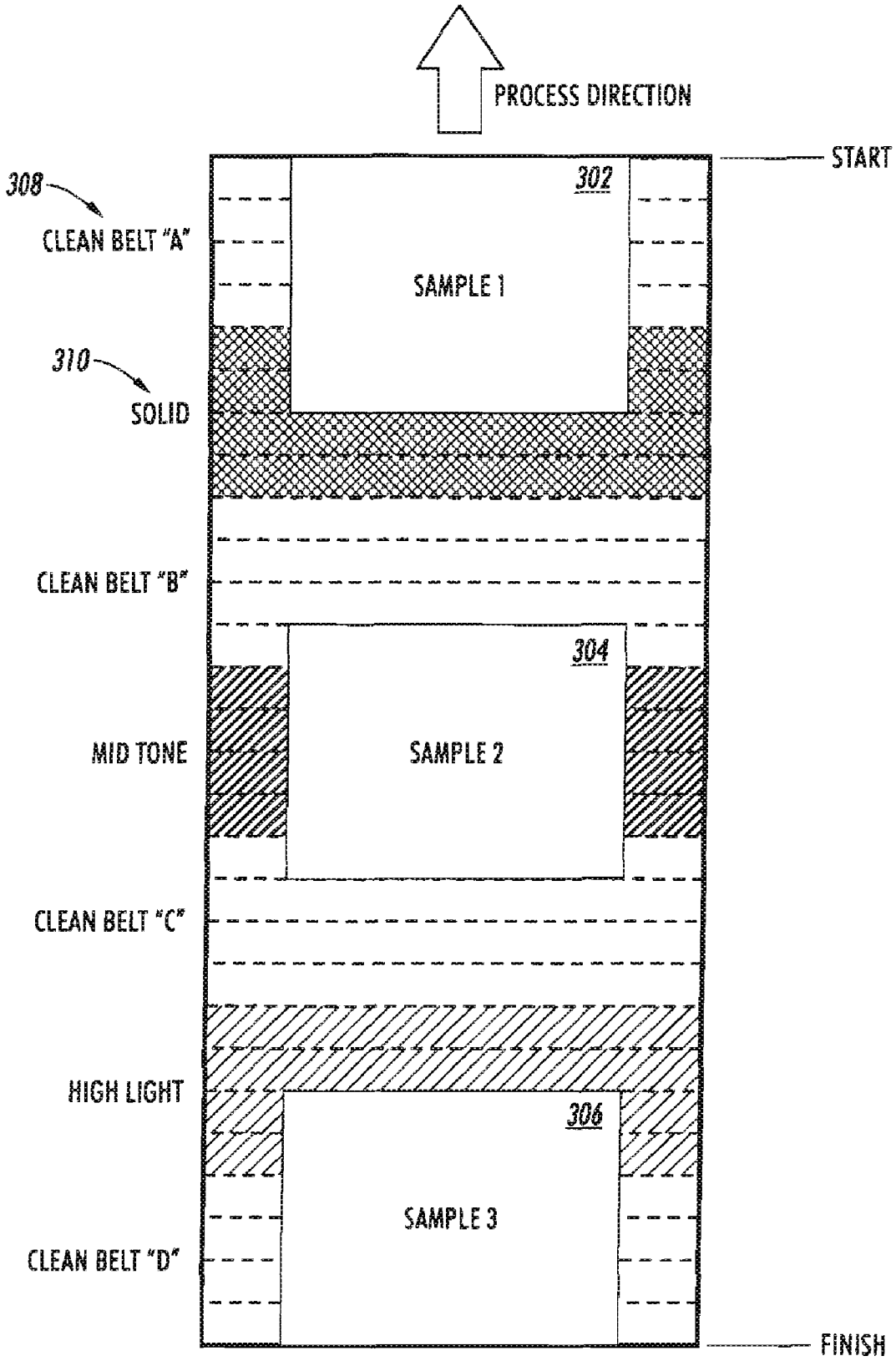
FIG. 4 illustrates a sensor reading several inter-document patches according to embodiments of the present disclosure.

With reference now to FIG. 4, an illustration of a sensor reading several inter-document patches is shown. The ETAC's field of view, which is shown by sample 1 (302), sample 2 (304), and sample 3 (306), is 1.5 times the size of each patch. As mentioned above, the ETAC will begin sampling when a group of patches completely fall under the entire ETAC field of view, which is illustrated at sample 1 (302). Since each sample is 3 mm, and each patch is only 2 mm, the ETAC will not begin sampling until the ETAC, as shown at sample 1 (302), falls completely over Clean Belt A Patch (308), and falling over ½ of Solid Patch (310). The ETAC will continue take samples until the end of the patch layout, which is shown at sample 3 (306).

Because there is knowledge as to the dimensions and layout of each patch, obtaining a sensor read (FIG. 3, block 204) can be viewed as an expression relating the sensor read to the sequence of input patches: (See Table 1, below)

TABLE 1

| | | | | | | | | | | | | | | | |
|---|---|---|---|---|---|---|---|---|---|---|---|---|---|---|---|
| EtacRead1 = | 1 | 1 | 1 | 1 | 1 | 1 | 0 | 0 | 0 | 0 | 0 | 0 | 0 | 0 | 0 |
| EtacRead2 = | 0 | 1 | 1 | 1 | 1 | 1 | 1 | 0 | 0 | 0 | 0 | 0 | 0 | 0 | 0 |
| EtacRead3 = | 0 | 0 | 1 | 1 | 1 | 1 | 1 | 1 | 0 | 0 | 0 | 0 | 0 | 0 | 0 |
| EtacRead4 = | 0 | 0 | 0 | 1 | 1 | 1 | 1 | 1 | 1 | 0 | 0 | 0 | 0 | 0 | 0 |
| EtacRead5 = | 0 | 0 | 0 | 0 | 1 | 1 | 1 | 1 | 1 | 1 | 0 | 0 | 0 | 0 | 0 |
| EtacRead6 = | 0 | 0 | 0 | 0 | 0 | 1 | 1 | 1 | 1 | 1 | 1 | 0 | 0 | 0 | 0 |
| EtacRead7 = | 0 | 0 | 0 | 0 | 0 | 0 | 1 | 1 | 1 | 1 | 1 | 1 | 0 | 0 | 0 |
| EtacRead8 = | 0 | 0 | 0 | 0 | 0 | 0 | 0 | 1 | 1 | 1 | 1 | 1 | 1 | 0 | 0 |
| EtacRead9 = | 0 | 0 | 0 | 0 | 0 | 0 | 0 | 0 | 1 | 1 | 1 | 1 | 1 | 1 | 0 |
| EtacRead10 = | 0 | 0 | 0 | 0 | 0 | 0 | 0 | 0 | 0 | 1 | 1 | 1 | 1 | 1 | 1 |
| EtacRead11 = | 0 | 0 | 0 | 0 | 0 | 0 | 0 | 0 | 0 | 0 | 1 | 1 | 1 | 1 | 1 |
| EtacRead12 = | 0 | 0 | 0 | 0 | 0 | 0 | 0 | 0 | 0 | 0 | 0 | 1 | 1 | 1 | 1 |
| EtacRead13 = | 0 | 0 | 0 | 0 | 0 | 0 | 0 | 0 | 0 | 0 | 0 | 0 | 1 | 1 | 1 |
| EtacRead14 = | 0 | 0 | 0 | 0 | 0 | 0 | 0 | 0 | 0 | 0 | 0 | 0 | 0 | 1 | 1 |
| EtacRead15 = | 0 | 0 | 0 | 0 | 0 | 0 | 0 | 0 | 0 | 0 | 0 | 0 | 0 | 0 | 1 |
| EtacRead16 = | 0 | 0 | 0 | 0 | 0 | 0 | 0 | 0 | 0 | 0 | 0 | 0 | 0 | 0 | 0 |
| EtacRead17 = | 0 | 0 | 0 | 0 | 0 | 0 | 0 | 0 | 0 | 0 | 0 | 0 | 0 | 0 | 0 |
| EtacRead18 = | 0 | 0 | 0 | 0 | 0 | 0 | 0 | 0 | 0 | 0 | 0 | 0 | 0 | 0 | 0 |
| EtacRead19 = | 0 | 0 | 0 | 0 | 0 | 0 | 0 | 0 | 0 | 0 | 0 | 0 | 0 | 0 | 0 |
| EtacRead20 = | 0 | 0 | 0 | 0 | 0 | 0 | 0 | 0 | 0 | 0 | 0 | 0 | 0 | 0 | 0 |
| EtacRead21 = | 0 | 0 | 0 | 0 | 0 | 0 | 0 | 0 | 0 | 0 | 0 | 0 | 0 | 0 | 0 |
| EtacRead22 = | 0 | 0 | 0 | 0 | 0 | 0 | 0 | 0 | 0 | 0 | 0 | 0 | 0 | 0 | 0 |
| EtacRead23 = | 0 | 0 | 0 | 0 | 0 | 0 | 0 | 0 | 0 | 0 | 0 | 0 | 0 | 0 | 0 |
| EtacRead24 = | 0 | 0 | 0 | 0 | 0 | 0 | 0 | 0 | 0 | 0 | 0 | 0 | 0 | 0 | 0 |

| | | | | | | | | | | | | | | | |
|---|---|---|---|---|---|---|---|---|---|---|---|---|---|---|---|
| EtacRead1 = | 0 | 0 | 0 | 0 | 0 | 0 | 0 | 0 | 0 | 0 | 0 | 0 | 0 | 0 | CBa |
| EtacRead2 = | 0 | 0 | 0 | 0 | 0 | 0 | 0 | 0 | 0 | 0 | 0 | 0 | 0 | 0 | CBa |
| EtacRead3 = | 0 | 0 | 0 | 0 | 0 | 0 | 0 | 0 | 0 | 0 | 0 | 0 | 0 | 0 | CBa |
| EtacRead4 = | 0 | 0 | 0 | 0 | 0 | 0 | 0 | 0 | 0 | 0 | 0 | 0 | 0 | 0 | CBa |
| EtacRead5 = | 0 | 0 | 0 | 0 | 0 | 0 | 0 | 0 | 0 | 0 | 0 | 0 | 0 | 0 | Solid |
| EtacRead6 = | 0 | 0 | 0 | 0 | 0 | 0 | 0 | 0 | 0 | 0 | 0 | 0 | 0 | 0 | Solid |
| EtacRead7 = | 0 | 0 | 0 | 0 | 0 | 0 | 0 | 0 | 0 | 0 | 0 | 0 | 0 | 0 | Solid |
| EtacRead8 = | 0 | 0 | 0 | 0 | 0 | 0 | 0 | 0 | 0 | 0 | 0 | 0 | 0 | 0 | Solid |
| EtacRead9 = | 0 | 0 | 0 | 0 | 0 | 0 | 0 | 0 | 0 | 0 | 0 | 0 | 0 | 0 | CBb |
| EtacRead10 = | 0 | 0 | 0 | 0 | 0 | 0 | 0 | 0 | 0 | 0 | 0 | 0 | 0 | 0 | CBb |
| EtacRead11 = | 1 | 0 | 0 | 0 | 0 | 0 | 0 | 0 | 0 | 0 | 0 | 0 | 0 | 0 | CBb |
| EtacRead12 = | 1 | 1 | 0 | 0 | 0 | 0 | 0 | 0 | 0 | 0 | 0 | 0 | 0 | 0 | CBb |
| EtacRead13 = | 1 | 1 | 1 | 0 | 0 | 0 | 0 | 0 | 0 | 0 | 0 | 0 | 0 | 0 | Mid |
| EtacRead14 = | 1 | 1 | 1 | 1 | 0 | 0 | 0 | 0 | 0 | 0 | 0 | 0 | 0 | 0 | Mid |
| EtacRead15 = | 1 | 1 | 1 | 1 | 1 | 0 | 0 | 0 | 0 | 0 | 0 | 0 | 0 | 0 | Mid |
| EtacRead16 = | 1 | 1 | 1 | 1 | 1 | 1 | 0 | 0 | 0 | 0 | 0 | 0 | 0 | 0 | Mid |
| EtacRead17 = | 0 | 1 | 1 | 1 | 1 | 1 | 1 | 0 | 0 | 0 | 0 | 0 | 0 | 0 | CBc |
| EtacRead18 = | 0 | 0 | 1 | 1 | 1 | 1 | 1 | 1 | 0 | 0 | 0 | 0 | 0 | 0 | CBc |
| EtacRead19 = | 0 | 0 | 0 | 1 | 1 | 1 | 1 | 1 | 1 | 0 | 0 | 0 | 0 | 0 | CBc |
| EtacRead20 = | 0 | 0 | 0 | 0 | 1 | 1 | 1 | 1 | 1 | 1 | 0 | 0 | 0 | 0 | CBc |
| EtacRead21 = | 0 | 0 | 0 | 0 | 0 | 1 | 1 | 1 | 1 | 1 | 1 | 0 | 0 | 0 | Low |
| EtacRead22 = | 0 | 0 | 0 | 0 | 0 | 0 | 1 | 1 | 1 | 1 | 1 | 1 | 0 | 0 | Low |
| EtacRead23 = | 0 | 0 | 0 | 0 | 0 | 0 | 0 | 1 | 1 | 1 | 1 | 1 | 1 | 0 | Low |
| EtacRead24 = | 0 | 0 | 0 | 0 | 0 | 0 | 0 | 0 | 1 | 1 | 1 | 1 | 1 | 1 | Low |

(Where CB refers to clean belt)

The ETAC reads are in the left hand column (EtacRead1=the first read of the ETAC sensor). The group of six 1's shifts to the right as time passes to correspond to each patch strip entering and leaving the ETAC field of view. The dimensions of the above matrix are 24×28 (only 24 reads are possible when the ETAC is constrained to reside somewhere over the patch, and there are 28 patch elements given this example's patch size, sampling rate, and field of view). The vector on the right can be in turn expressed as: (See Table 2, below)

TABLE 2

| | | | | | | | |
|---|---|---|---|---|---|---|---|
| 1 | 0 | 0 | 0 | 0 | 0 | 0 | CBa |
| 1 | 0 | 0 | 0 | 0 | 0 | 0 | Solid |
| 1 | 0 | 0 | 0 | 0 | 0 | 0 | CBb |
| 1 | 0 | 0 | 0 | 0 | 0 | 0 | Mid |
| 0 | 1 | 0 | 0 | 0 | 0 | 0 | CBc |
| 0 | 1 | 0 | 0 | 0 | 0 | 0 | Low |
| 0 | 1 | 0 | 0 | 0 | 0 | 0 | CBd |
| 0 | 1 | 0 | 0 | 0 | 0 | 0 | CBa |
| 0 | 0 | 1 | 0 | 0 | 0 | 0 | Solid |
| 0 | 0 | 1 | 0 | 0 | 0 | 0 | CBb |
| 0 | 0 | 1 | 0 | 0 | 0 | 0 | Mid |
| 0 | 0 | 1 | 0 | 0 | 0 | 0 | CBc |
| 0 | 0 | 0 | 1 | 0 | 0 | 0 | Low |
| 0 | 0 | 0 | 1 | 0 | 0 | 0 | CBd |
| 0 | 0 | 0 | 1 | 0 | 0 | 0 | CBa |
| 0 | 0 | 0 | 1 | 0 | 0 | 0 | Solid |
| 0 | 0 | 0 | 0 | 1 | 0 | 0 | CBb |
| 0 | 0 | 0 | 0 | 1 | 0 | 0 | Mid |
| 0 | 0 | 0 | 0 | 1 | 0 | 0 | CBc |
| 0 | 0 | 0 | 0 | 1 | 0 | 0 | Low |
| 0 | 0 | 0 | 0 | 0 | 1 | 0 | CBd |
| 0 | 0 | 0 | 0 | 0 | 1 | 0 | CBa |
| 0 | 0 | 0 | 0 | 0 | 1 | 0 | Solid |
| 0 | 0 | 0 | 0 | 0 | 1 | 0 | CBb |
| 0 | 0 | 0 | 0 | 0 | 0 | 1 | Mid |
| 0 | 0 | 0 | 0 | 0 | 0 | 1 | CBc |
| 0 | 0 | 0 | 0 | 0 | 0 | 1 | Low |
| 0 | 0 | 0 | 0 | 0 | 0 | 1 | CBd |

The dimensions and structure of the matrix in Table 1 are 28×7, with 28 patch elements and 7 patch levels. For computing the values received from the reads (block 206), the goal is to estimate the 7 values for Cba, Solid, CBb, Mid, CBc, Low, and CBd. This may be accomplished via least squares:

Since,

EtacRead_vector=(24×28)*(28×7)*[*Cba*, Solid, *CBb*, Mid, *CBc*, Low, CBd]'

Then,

EtacRead_vector=(24×7)*[*Cba*, Solid, *CBb*, Mid, *CBc*, Low, CBd]'

Therefore, the least squares estimates are: (Where *A*=24×7 Matrix; *A'=the transpose)*

[Cba, Solid, CBb, Mid, CBc, Low, CBd]' is

Inverse(A' A) (A' EtacRead_vector)

As described above, the estimates are then normalized by the computation of relative reflectance, For example, the "Mid" is normalized with respect to the average of the estimates for "CBb" and "CBc:" Mid/((CBb+CBc)/2). Thus, scaling the Mid read by the average clean belt reads just before and after it.

At block 208, timing is automatically analyzed and adjusted if needed. For the illustration above, it was assumed there was no timing error. Referring to Table 3 (below), the absence of a timing error is indicated in column A. For this example, a 0.7 read is assumed to represent the solid or "Solid," a 0.4 for the mid tone or "Mid," 0.15 for the highlight or "Low," and a read of 0 for each clean belt. These values may vary because of noise in development as well as sensor noise. Note, however, that all clean belts reads, Cba, CBb, CBc, and CBd should be essentially equal and the Solid, Mid, and Low patch reads should order accordingly. If there is a timing shift of 2 units, as shown in column B, then the estimates of CBa, CBb, CBc, and CBd will differ substantially. In embodiments, an analysis of variance (ANOVA), or any other means of detecting statistically significant differences can be automatically conducted, and thus the timing adjusted such that the differences are minimized, as shown in column C. This approach will set the timing and will be generally robust under noisy conditions.

TABLE 3

| | A | B | C |
|---|---|---|---|
| CBa | 0 | 0 | 0 |
| CBa | 0 | 0 | 0 |
| CBa | 0 | 0.7 | 0 |
| CBa | 0 | 0.7 | 0 |
| Solid | 0.7 | 0.7 | 0.7 |
| Solid | 0.7 | 0.7 | 0.7 |
| Solid | 0.7 | 0 | 0.7 |
| Solid | 0.7 | 0 | 0.7 |
| CBb | 0 | 0 | 0 |
| CBb | 0 | 0 | 0 |
| CBb | 0 | 0.4 | 0 |
| CBb | 0 | 0.4 | 0 |
| Mid | 0.4 | 0.4 | 0.4 |
| Mid | 0.4 | 0.4 | 0.4 |
| Mid | 0.4 | 0 | 0.4 |
| Mid | 0.4 | 0 | 0.4 |
| CBc | 0 | 0 | 0 |
| CBc | 0 | 0 | 0 |
| CBc | 0 | 0.15 | 0 |
| CBc | 0 | 0.15 | 0 |
| Low | 0.15 | 0.15 | 0.15 |
| Low | 0.15 | 0.15 | 0.15 |
| Low | 0.15 | 0 | 0.15 |
| Low | 0.15 | 0 | 0.15 |
| CBd | 0 | 0 | 0 |
| CBd | 0 | 0 | 0 |
| CBd | 0 | 0 | 0 |
| CBd | 0 | 0 | 0 |

In further embodiments, the timing and accuracy of the sensor is adjusted after every print job. This produces a margin of error so negligible, that the sensor will be able to be directly over patches from about 0.1 mm to equal to or less than the field of view of the sensor without missing the patch and losing the quality of a read.

With the size and location of each patch predetermined, this allows for more patches in a smaller IDZ, therefore gathering more information in at least the same amount of time as previous methods. However, with the sizes of the patches being considerably smaller, and therefore having more of them, the speed of the sensor interface board will need to be adjusted in order to keep the speed of the print job equivalent to current standards. The speed at which the sensor interface board will need to be adjusted will vary by the size of the sensor view, L, and by the photoreceptor speed, V, but a sufficient rate can be defined as: 10*V/L Hz. One with ordinary skill in the art will appreciate that a speed of ~1.66 kHz is obtainable with current technology as shown in the previous example.

In still further embodiments, after every print job, the density of the toner is analyzed and adjusted if needed. As mentioned above, a common technique for monitoring the quality of prints is to create a test patch or patch of toner of a predetermined desired density. Referring to Table 4 (below), the predetermined values, that is the desired density, of each Solid, Mid and Low test patch is indicated in column A, for example, Solid=0.7, Mid=0.4, and Low=0.15.

TABLE 4

| | A | B | C |
|---|---|---|---|
| CBa | 0 | 0 | 0 |
| CBa | 0 | 0 | 0 |
| CBa | 0 | 0 | 0 |
| CBa | 0 | 0 | 0 |
| Solid | 0.7 | 0.6 | 0.7 |
| Solid | 0.7 | 0.6 | 0.7 |
| Solid | 0.7 | 0.6 | 0.7 |
| Solid | 0.7 | 0.6 | 0.7 |
| CBb | 0 | 0 | 0 |
| CBb | 0 | 0 | 0 |
| CBb | 0 | 0 | 0 |
| CBb | 0 | 0 | 0 |
| Mid | 0.4 | 0.35 | 0.4 |
| Mid | 0.4 | 0.35 | 0.4 |
| Mid | 0.4 | 3.35 | 0.4 |
| Mid | 0.4 | 0.35 | 0.4 |
| CBc | 0 | 0 | 0 |
| CBc | 0 | 0 | 0 |
| CBc | 0 | 0 | 0 |
| CBc | 0 | 0 | 0 |
| Low | 0.15 | 2 | 0.15 |
| Low | 0.15 | 2 | 0.15 |
| Low | 0.15 | 2 | 0.15 |
| Low | 0.15 | 2 | 0.15 |
| CBd | 0 | 0 | 0 |
| CBd | 0 | 0 | 0 |
| CBd | 0 | 0 | 0 |
| CBd | 0 | 0 | 0 |

The values in column B represent the values obtained from the sensor after a print job has been performed, for example, Solid=0.6, Mid=0.35 and Low=2. As shown, each of the Solid, Mid and Low test patches is slightly off target from the predetermined values. Thus, adjustment actuators may be used to perform the needed adjustments to the density of the toner, which will yield values equal to the predetermined values, as shown in column C.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of monitoring one or more patches, either in an inter-document zone or an image zone, in an image processing device comprised of a photoreceptor with one or more patches printed thereon, a controller, and a sensor, comprising:

obtaining specular readings and diffuse readings directly from the one or more patches printed on the photoreceptor;

computing values received from the readings; and wherein the one or more patches are equal to or less than the field of view of the sensor;

wherein each patch size, location, and approximate value is predetermined; and automatically detecting statistically significant differences from the predetermined size, location, and approximate value of each patch.

2. The method of claim 1, wherein the one or more inter-document patches or image zone patches comprise toner patches and/or clean belt patches.

3. The method of claim 1, wherein the sensor is an optical reflective sensing device.

4. The method of claim 1, wherein the sensor is a transmissive sensing device.

5. The method of claim 1, wherein detecting statistically significant differences is automatically conducted using an analysis of variance (ANOVA).

6. A system for monitoring one or more patches printed on a photoreceptor, either in an inter-document zone or an image zone, in an image processing device, comprising:

the photoreceptor;

a raster output scanner (ROS);

a sensor adapted to obtain specular readings and diffuse readings directly from the one or more patches printed on the photoreceptor; and a controller;

wherein the patches are from about 0.1 mm to equal to or less than the field of view of the sensor.

7. The system of claim 6, wherein the sensor is one of an optical transmissive sensing device or a reflective sensing device.

8. The system of claim 6, wherein the sensor is an extended toner area coverage sensor.

9. The system of claim 6, wherein the patches comprise toner patches and/or clean belt patches.

10. The system of claim 6, wherein the sensor obtains specular readings and/or diffuse readings for light reflected from the photoreceptor and the one or more patches.

11. The system of claim 10, wherein the sensor obtains transmitted light readings for light transmitted through the photoreceptor and the one or more patches.

12. The system of claim 6, wherein the ROS generates one or more of the inter-document zone patches or image zone patches.

13. The system of claim 6, wherein the controller computes specular based developed mass per unit area (DMA) values and/or relative reflectance values.

14. A method of regulating a xerographic marking device comprised of a photoreceptor, a controller, and a sensor, comprising:

obtaining specular readings and diffuse readings directly from one or more inter-document patches or image patches printed on the photoreceptor;

wherein the one or more patches are equal to or less than the field of view of the sensor;

computing specular based developed mass per unit area (DMA) values and/or relative reflectance values; and adjusting one or more of the xerographic device's timing and toner image quality based on the information obtained from the one or more inter-document patches or image patches.

15. The method of claim 14, wherein the one or more inter-document patches or image patches comprise toner patches and clean belt patches.

16. The method of claim 15, wherein a sequence of the toner patches and the clean belt patches is specified.

17. The method of claim 14, wherein adjusting one or more of the xerographic device's timing image quality is performed in real time.

18. The method of claim 14, wherein adjusting one or more of the xerographic device's timing image quality is performed after each print job.

* * * * *